United States Patent [19]

Lakso

[11] 4,010,699

[45] Mar. 8, 1977

[54] SELF-ERECTING FOLDING STEP STOOL

[76] Inventor: Eino E. Lakso, Box 257, Fitchburg, Mass. 01420

[22] Filed: Jan. 11, 1974

[21] Appl. No.: 432,661

Related U.S. Application Data

[63] Continuation-in-part of Ser. No. 276,744, July 31, 1972, Pat. No. 3,805,711.

[52] U.S. Cl. ..... 108/133

[51] Int. Cl.² ..... A47B 3/00

[58] Field of Search ..... 108/129, 130, 131, 132, 108/133

[56] References Cited

UNITED STATES PATENTS

| | | | |
|---|---|---|---|
| 155,999 | 10/1874 | Valley | 108/131 |
| 290,932 | 12/1883 | Richardson | 108/133 |
| 320,413 | 6/1885 | Thayer | 108/133 |
| 1,312,137 | 8/1919 | Schloss | 108/131 |
| 1,519,543 | 12/1924 | Kubinyi | 108/132 |
| 2,485,178 | 10/1949 | Weinkauf | 108/132 |
| 2,784,042 | 3/1957 | Clapper | 108/132 |
| 3,805,711 | 4/1974 | Lakso | 108/133 |

*Primary Examiner*—Ramon S. Britts
*Assistant Examiner*—Darrell Marquette
*Attorney, Agent, or Firm*—Charles R. Fay

[57] ABSTRACT

A self-erecting step stool comprising a top, pivoted leg structures at the ends of the top, a pivoted leg holding strut between the legs and having positive engagement therewith when the legs are extended; a strengthening rib secured or integral to the top at the underside thereof, said pivoted strut being pivoted in journals which are secured to said strengthening rib whereby sidewise thrust on the leg structures at the ends of the step stool is transferred through the pivoted strut to the strengthening rib and thence to the top.

4 Claims, 7 Drawing Figures

SELF-ERECTING FOLDING STEP STOOL

This case is a continuation-in-part of Ser. No. 276,744, filed July 31, 1972, U.S. Pat. No. 3,805,711.

BACKGROUND OF THE INVENTION

Attention is directed to the above identified application. In order to manufacture the step stool disclosed in that application in the form of molded plastic parts or similar material, which in general practice cannot exceed 3/16 inch in thickness at any one area, certain differences in construction have been made in order to provide for a sturdy structure which however is operable just as easily as that disclosed in said application; that is, the operator merely grasps handles at the ends of the top portion of the device and gives it a relatively mild shake, whereupon the legs snap out as by gravity and the strut is biassed into leg supporting and clamped position with respect thereto.

SUMMARY OF THE INVENTION

The self-erecting stool of the present invention comprises a top member, supporting leg structures hinged with respect thereto and extending generally at right angles to the top member to support the same in an extended or erected condition but at the same time being foldable downwardlly onto the top member and lightly latched in this condition, overlying a folding strut which is adapted to hold said legs in erect position and also including latching or locking means connecting the folding strut and the folding leg structures holding the same from any tendency to move in either direction.

The center strut being connected with respect to said leg structures, transmits stresses imparted thereon by said leg structures to a center portion of the top member at the underside thereof where there is a strengthening rib that the pivoted strut is pivotally mounted upon, the stresses therefore being transmitted from the leg structures to the center of the top portion.

Also, when a person stands on the step stool, the downward pressure thereon is distributed generally throughout the top portion and transferred in part along said pivoted strut to said leg structures.

PREFERRED EMBODIMENT OF THE INVENTION

Figure 1:
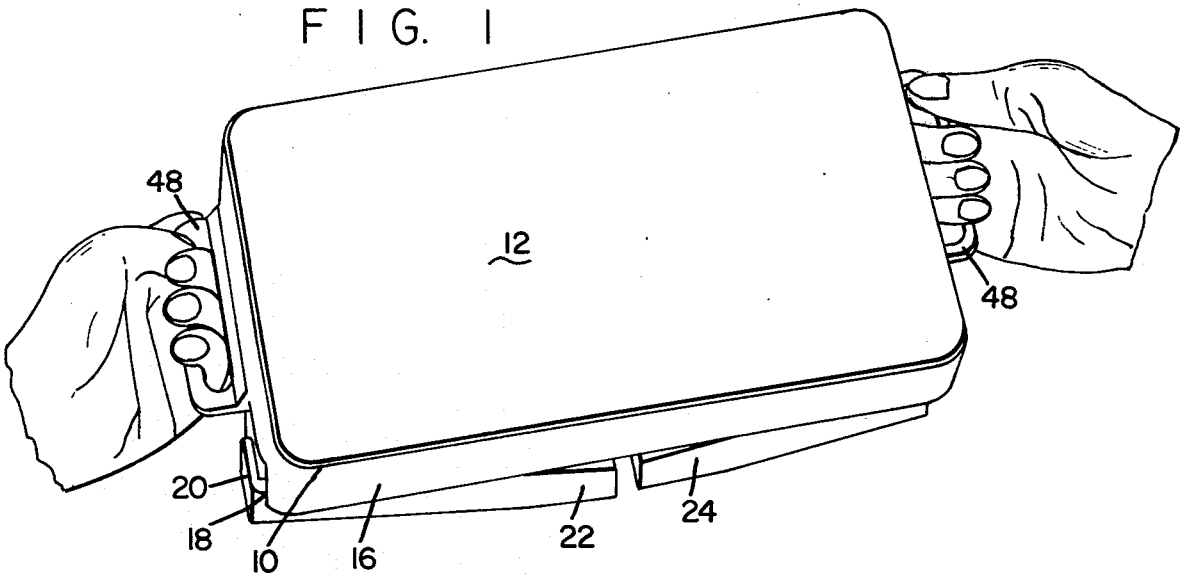
FIG. 1 is a perspective view illustrating the operation in erecting the stool.

It is preferred that the step stool of the present invention shall be rectangular and it comprises a top member generally indicated at 10 which may have a non-skid cover 12 of any generally acceptable composition. The top member 10 is provided with an interrupted rim which is indicated at 14 and 16, this rim in general terminating adjacent the ends thereof as at 18, 18 accommodating the edge portions 20, 20 of two leg structures 22 and 24. These legs are shown folded in FIG. 2 and extended in FIG. 4 and the terminal portions 20, 20 abut the underside of the table top member 10 to hold the same in extended condition, see FIG. 3, at 21.

The two leg structures 22 and 24 are pivotally mounted as for instance on pins 26, 26 mounted in members 28, 28 and pivoted with respect to fixed journals 30, 30. These journals are mounted at the underside of the table top and pivotally mount the leg structures between the folded condition of FIG. 2 and the extended position of FIGS. 3, 4, and 5.

Figure 3:
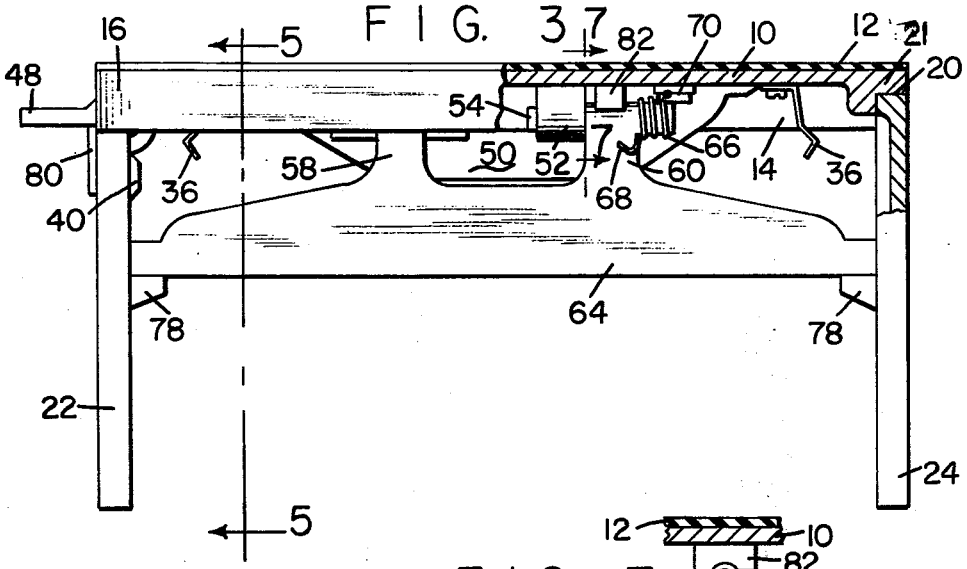
FIG. 3 is a view in side elevation showing the stool in erect form, parts being broken away and in section.
Figure 6:
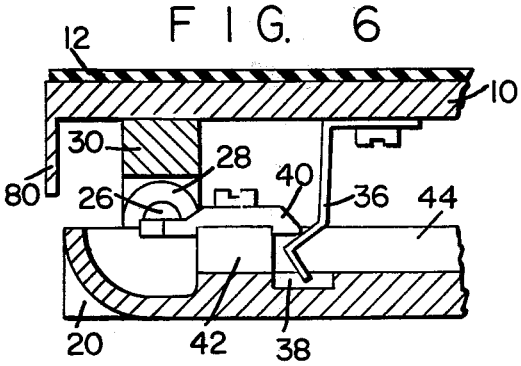
FIG. 6 is an enlarged sectional view illustrating a spring clip for holding the legs folded.

The legs are held in folded relation with respect to top 10 as for instance by bent spring members 36, see FIGS. 3 and 6, which snap into openings 38 formed by overlapping members 40 mounted on supports 42 with respect to the inner sides at 44 of the leg structures 22 and 24.

Figure 2:
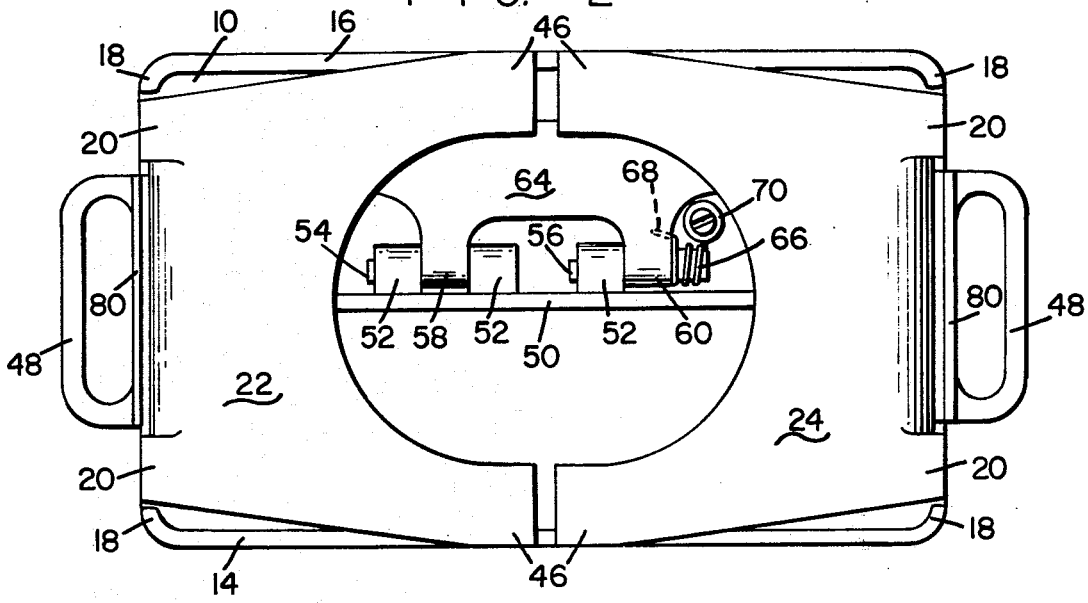
FIG. 2 is a bottom plan view with the parts folded.
Figure 4:
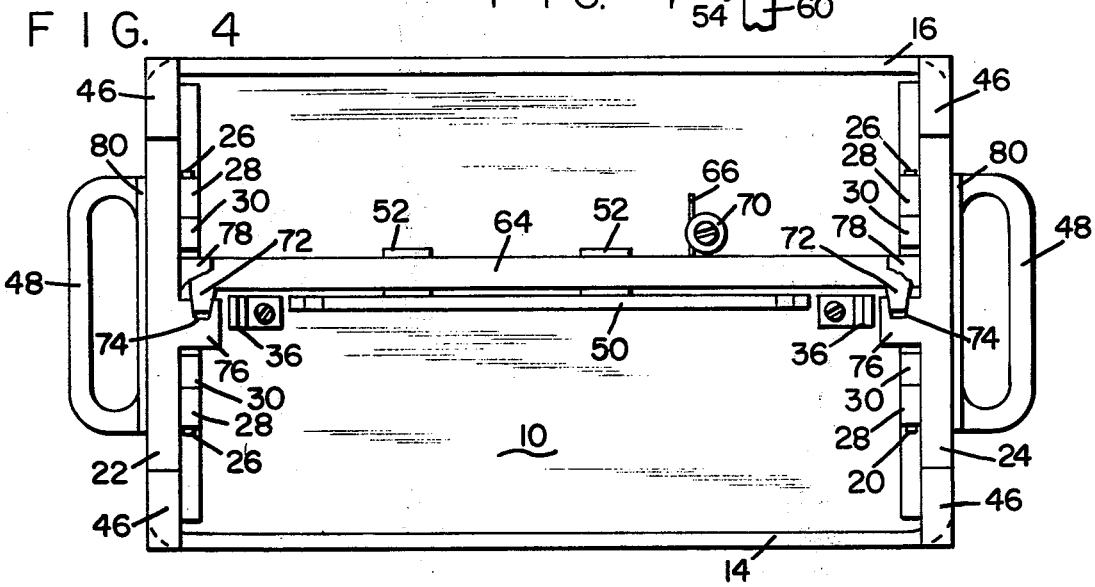
FIG. 4 is a bottom plan view of the stool showing the same in erect condition, parts being broken away.
Figure 5:
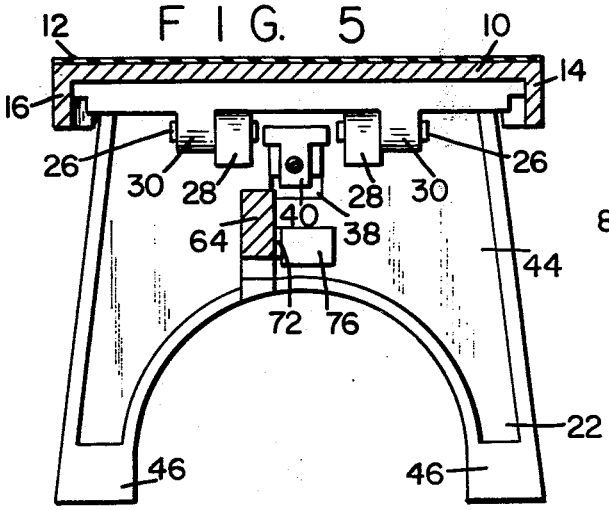
FIG. 5 is a section on line 5 of FIG. 3.

Each leg structure 22 and 24 may be a two footed design as most clearly shown in FIGS. 2 and 4 having feet at 46, 46 which may be rubber covered if desired. The top member 10 is provided with outstanding end handles 48, 48.

Approximately midway of the top 10 and parallel to the longer sides thereof in the event that the shape is rectangular, there is a downwardly extending strengthening rib 50. This strengthening rib does not necessarily extend from end to end of the device but it is provided with journals 52 which are preferably integral therewith or rigidly secured thereto and these journals are likewise secured to the table top 10. Each journal is provided with a pin 54, 56 which extends through the legs 58 and 60 of a central swinging strut 64 which lies flat against the underside of the top member as shown in FIG. 2 or extended at right angles with respect thereto as shown in FIG. 3. This strut is slightly off center with regard to the center line of the top and it swings on its pivots 54 and 56 to one side of the strengthening rib 50 but it cannot pivot outwardly away from the top any farther than the strengthening rib.

A spring 66 bears at 68 on the strut, this spring being anchored to the underside of the top member at 70 and always moves the strut to its extended position when the strut is released by the overlying legs 22, 24, see FIG. 2. The legs hold the strut in folded condition when lightly latched as by springs 36.

At each end the strut 64 is provided with extending wedge type locks or clamps 72, 72 and when the strut extends into the FIG. 3 and 4 position, these wedges lock into correspondingly wedge shaped openings 74, 74 in locking blocks 76, 76 which are mounted on the inside aspects of the leg structures. Thus it will be seen that any lateral stress placed on the leg structures when they are extended is transferred through the strut 64 and in some degree to the strengthening rib 50. On the other hand when one is standing on the top member the weight being concentrated at the center thereof, any tendency to spread legs 22 and 24 is prevented by the fact that the stress is transferred to the rib 50, strut 64, and the locking devices 72, 74 which lock the strut to the legs against motion of the legs in either direction right or left as viewed in FIG. 4.

In addition, there is a block 78 on each leg which receives the ends of the pivoted strut, forming abutments for carrying weight or transferring weight pressure from the strut to the leg structures. These blocks are shown broken away in FIG. 4 and are also shown in FIG. 3.

Also, downwardly extending abutments 80 may be utilized for finger guards, preventing any possible pinching.

Figure 7:
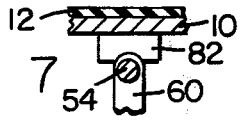
FIG. 7 is a section on line 7—7 of FIG. 3.

Abutments 80 are mounted on the stool top. Further, concaved blocks 82 are provided at the under surface of the top member to support the legs 58 and 60 of the strut and form pressure points, see FIG. 7, for the reasons described just above.

It will therefore be seen that the present construction provides an improvement over that disclosed in the identified patent application. Because of the improvements in the present case the same may be made of molded plastic parts for instance and at the same time the device is made strong enough. The moving parts are all in a sense intergrated in such a way as to firmly hold the stool in erected condition but at the same time no interference is made to the smooth and simple folding operation. The stool is erected as described in the above identified applicatiion merely by grasping the handles and giving them a slight shake away from the body as is illustrated in FIG. 1.

I claim:

1. A self-erecting article comprising a top member, legs pivotally associated with said top member at the respective end portions thereof, a handle adjacent each leg, said legs having erect positions generally at right angles with respect to the top member and folded positions generally parallel thereto, a strut having a main body portion, means pivoting said strut to said top member at the underside thereof adjacent the center of the top member on an axis at right angles to the pivot axes of said legs, and means biassing said main body portion of the strut to extended condition outwardly from the top member, said strut main body portion having a length equal to the distance between the legs when extended, interengaging automatic locking means between the ends of the strut main body portion and each of said legs for holding said legs generally fixed with respect to said strut in extended condition thereof, said automatic locking means comprising a pair of wedge shaped locks projecting laterally from the main body portion of said strut there being one of said wedge shaped locks located at each end of said strut, and a pair of locking blocks one locking block at said pair being rigidly mounted on the inside surface of one of said legs adjacent to said strut in the erected condition thereof and the other locking block being similarly mounted on the other leg, each of said locking blocks having a wedge shaped opening facing said strut for receiving one of said wedge shaped locks when said strut is pivoted to its extended condition, and yielding means lightly holding the legs superimposed on the strut when folded, said yielding means having a strength thereof allowing separation of the legs upon a slight downward shake applied to the top member while grasping the handles, thus bringing the legs into an erected and locked condition.

2. The article of claim 1 including abutments on legs underlying said strut at the end portions thereof in extended condition of the strut.

3. The self-erecting article according to claim 1 together with a longitudinal strengthening rib on the underside of said top member, said strengthening rib being generally located perpendicular with respect to said top member and also with respect to said legs when extended, said means for pivoting said strut including journals rigidly mounted on and extending laterally from said rib and abutting the underside of said top member and coaxial pivot pins rigidly secured to said strut and pivotally engaged in said journals, and abutments on said legs positioned to engage underneath the ends of said strut in the erected conditions thereof, said strengthening rib being adapted to transfer forces applied downwardly upon said top member through said journals and said pivot pins to said strut in the erected condition thereof, and said abutments being adapted to transfer forces from said strut to said legs.

4. A self-erecting article comprising a top member, legs pivotally associated with said top member in mutually spaced condition with respect thereto, said legs having erect positions generally at right angles with respect to the top member and folded positions generally parallel thereto, a strut having a main body portion, means pivoting said strut to said top member at the underside thereof adjacent the center of the top member on an axis at right angles to the pivot axes of said legs, and means biassing said main body portion of the strut to extended condition outwardly from the top member, said strut main body portion having a length equal to the distance between the legs when extended, interengaging automatic locking means between the ends of the strut main body portion and each of said legs for holding said legs generally fixed with respect to said strut in extended condition thereof, said automatic locking means comprising a pair of wedge shaped locks projecting laterally from the main body portion of said strut there being one of said wedge shaped locks located at each end of said strut, and a pair of locking blocks, one locking block of said pair being rigidly mounted on the inside surface of one said legs adjacent to said strut in the erected condition thereof and the other locking block being similarly mounted on the other leg, each of said locking blocks having a wedge shaped opening facing said strut for receiving one of said wedge shaped locks when said strut is pivoted to its extended condition, a strengthening rib on the underside of said top member, said strengthening rib being generally located perpendicular with respect to said top member and also with respect to said legs when extended, said means for pivoting said center strut being located on the strengthening rib, and abutments on said legs receiving and supporting the ends of said strut when erected, and means for releasably holding the leg structures in overlying relationship with respect to said central strut in folded condition thereof, said releasable holding means having a strength allowing release thereof upon a relatively slight shake applied to the top member.

* * * * *